US005595325A

United States Patent [19]

Leres

[11] Patent Number: 5,595,325

[45] Date of Patent: Jan. 21, 1997

[54] PORTABLE LIQUID SUPPLY

[76] Inventor: Stalios C. Leres, 2659 Halsey Ave., New Orleans, La. 70114

[21] Appl. No.: 517,743

[22] Filed: Aug. 22, 1995

[51] Int. Cl.[6] ..... B67D 5/52

[52] U.S. Cl. ..... 222/135; 222/175; 222/383.3; 224/148.4

[58] Field of Search ..... 222/135, 175, 222/383.1, 383.3; 224/148.4, 148.7, 628

[56] References Cited

U.S. PATENT DOCUMENTS

| | | | |
|---|---|---|---|
| 2,777,610 | 1/1957 | Fox et al. | 222/135 X |
| 3,987,869 | 10/1976 | Bowers | 224/628 X |
| 4,526,298 | 7/1985 | Boxer et al. | 222/130 |
| 4,815,635 | 3/1989 | Porter | 222/136 |
| 4,880,535 | 11/1989 | Burrows | 210/181 |
| 4,957,227 | 9/1990 | Trimble | 224/39 |
| 5,115,947 | 5/1992 | McDonnell et al. | 222/107 |
| 5,119,978 | 6/1992 | Kalamaras et al. | 224/32 R |
| 5,158,208 | 10/1992 | Wilson | 222/175 X |
| 5,238,149 | 8/1993 | Johnson et al. | 222/79 |
| 5,251,777 | 10/1993 | McMahon | 220/480 |
| 5,301,858 | 4/1994 | Hollander | 224/148 |
| 5,370,278 | 12/1994 | Raynie | 222/175 |

*Primary Examiner*—Joseph A. Kaufman
*Attorney, Agent, or Firm*—Joseph N. Breaux

[57] ABSTRACT

A portable liquid supply device including a container support frame, a pair of liquid storage containers interlinked by a transfer conduit having a transfer valve, a drinking tube assembly in connection with one of the liquid storage containers, and a spray nozzle assembly in connection with the other liquid storage container. Each liquid storage container includes a bottom reservoir member having a loading mouth in connection with an internal storage cavity, and a loading mouth lid, securable over the loading mouth aperture, having a tube aperture. Each bottom reservoir member includes a loop stop in connection with the exterior surface thereof.

7 Claims, 3 Drawing Sheets

PORTABLE LIQUID SUPPLY

TECHNICAL FIELD

The present invention relates to devices for transporting, storing, and dispensing fluids and more particularly to a device for transporting, storing, and dispensing water for drinking and cooling purposes that includes separate but interconnectable reservoirs for storing and transporting water for drinking and/or cooling.

BACKGROUND ART

When working in locations remote from conventional water supplies, such as municipal water and/or a potable well, supplying water for drinking and cooling purposes can be a problem. Drinking water is often supplied by placing a quantity of water and ice within a cooler having a spigot near the bottom thereof from which chilled water is dispensed into a cup or other drinking vessel. Water from the cooler may be used for cooling purposes by first dispensing the water into a cup or other container and then pouring the water over the head or neck. Although dousing the head and neck with water can supply cooling, it is inefficient and results in the rapid depletion of the limited quantity of water contained within the cooler. It would be a benefit, therefore, to have a dispensing device that also provided a misting or spraying mechanism. A cooling water mist could then be used to lightly coat a persons skin with a layer of water that would, in turn, evaporate and provide more cooling effect per quantity of water used. It would also be a benefit to have a dispensing mechanism that did not require the use of a serving vessel such as a cup. In addition, because it is generally not possible to predict whether the drinking water or the cooling water will be used at a faster rate than the other, it would be a benefit to include a mechanism for transferring water in either direction between the drinking water reservoir and the cooling water reservoir.

In addition, many water dispensing devices are difficult to clean. It would be a further benefit to provide a portable water supply device that was easily cleaned between fillings.

GENERAL SUMMARY DISCUSSION OF INVENTION

It is thus an object of the invention to provide a portable liquid supply that includes a misting mechanism supplied by liquid stored within the portable liquid supply.

It is a further object to provide a portable liquid supply that includes a dispensing mechanism that does not require the use of a serving vessel such as a cup.

It is a still further object of the invention to provide a portable liquid supply that includes a drinking liquid reservoir and a cooling liquid reservoir that are separated by a transfer conduit having a valving mechanism.

It is a still further object of the invention to provide a portable liquid supply that includes storage reservoirs that are easily cleaned.

It is a still further object to provide a portable liquid supply device that accomplishes all or some of the above objects in combination.

Accordingly, portable liquid supply device is provided. The portable liquid supply includes a container support frame, a pair of liquid storage containers interlinked by a transfer conduit having a transfer valve, a drinking tube assembly in connection with one of the liquid storage containers, and a spray nozzle assembly in connection with the other liquid storage container.

Each liquid storage container is constructed from an insulating, plastic material and includes a bottom reservoir member having a loading mouth in connection with an internal storage cavity, and a loading mouth lid, securable over the loading mouth aperture, having a tube aperture. Each bottom reservoir member includes a loop stop in connection with the exterior surface thereof. The loop stop is preferably a circumferential ring extending around a bottom section of the bottom reservoir member, and more preferably, an integrally formed circumferential ring located above the transfer conduit.

The container support frame includes a central support member connected between the first and second liquid storage container supports, and at least four lashing strap members. Each of the first and second liquid storage container supports includes a pair of spaced, coaxially aligned container support loops. The diameter of each container support loop is selected to allow a top section of the bottom reservoir member to pass therethrough but to prevent the loop stop of the bottom reservoir member from passing through the support loop.

The spacing between the container support loops is selected such that, when the loop stop is in contact with one of the container support loops, the top section of the bottom reservoir member extends through and past the other coaxially oriented container support loop a distance sufficient to allow the loading mouth lid to be secured over the loading mouth of the bottom reservoir member in a manner such that the loading mouth lid prevents passage of the top section through the adjacent container support loop. In a preferred embodiment the top section of the bottom reservoir member is externally threaded, the loading mouth lid is internally threaded, the outer diameter of the loading mouth lid is greater than the diameter of the container support loops, and the external threading on the top section and the internal threading of the loading mouth lid are positioned such that, when the loading mouth lid is completely threaded onto the top section, the loading mouth lid contacts the adjacent container support loop in a manner such that the liquid storage container is prevented from moving with respect to the pair of container support loops supporting the liquid storage container.

The transfer conduit is connected between the internal storage cavities of bottom reservoir members of the liquid storage containers at a point at least one-half (½") inch from the interior bottom surface of each internal storage cavity. Positioning the transfer conduit this distance above the interior bottom surface of the internal storage cavities minimizes the transfer of undesirable sediment between the two liquid storage containers and blockage of the transfer conduit by the same sedimentation. The transfer conduit includes a transfer valve installed between the bottom reservoir members to allow a user to transfer liquid between the bottom reservoir members.

The drinking tube assembly includes a draw tube, a flexible drinking tube, a tube aperture cap, and a drinking tube valve. In use, the draw tube is inserted through the tube aperture of the loading mouth lid and held in position by the tube aperture cap. The flexible drinking tube is in fluid communication with the draw tube in a manner such that a vacuum placed on the drinking tube causes fluid to move through the draw tube when the free end of the draw tube is below the surface of a liquid stored within the bottom reservoir member. The drinking tube valve is positionable between a first predetermined position and a second predetermined position. In the first predetermined position passage of liquid through the drinking tube is blocked. In the second predetermined position passage of liquid through the drinking tube is allowed. In a preferred embodiment, the drinking end of the drinking tube is adapted for connection with a drinking mechanism of a gas mask or other emergency breathing apparatus.

The spray nozzle assembly includes a draw tube, a flexible connecting tube, a tube aperture cap, and a pump-type spray nozzle. In use, the draw tube is inserted through the tube aperture of the loading mouth lid and held in position by the tube aperture cap. The flexible connecting tube is in fluid communication with the draw tube in a manner such that a vacuum placed on the drinking tube by actuation of the pump-type spray nozzle causes fluid to move through the draw tube, the flexible connecting tube, and out through the spray orifice of the pump-type spray nozzle.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
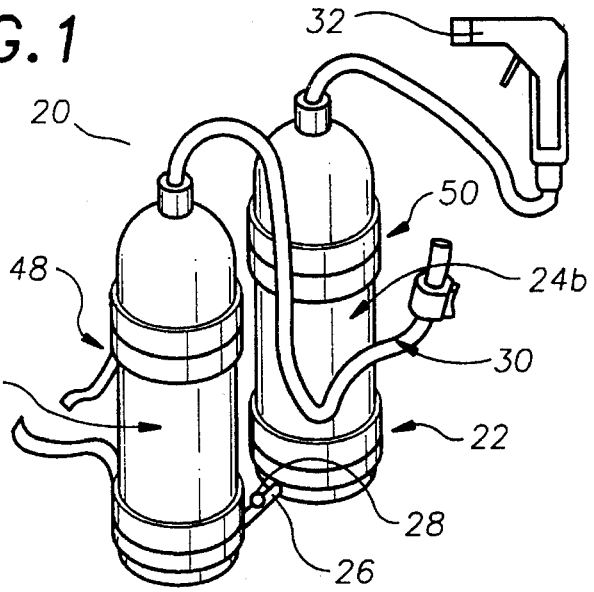
FIG. 1 is a perspective view of an exemplary embodiment of the portable liquid supply of the present invention showing the spray nozzle and the drinking tube.

FIG. 1 is a perspective view of an exemplary embodiment of the portable liquid supply of the present invention generally referenced by the numeral 20. Portable liquid supply 20 includes a container support frame, generally referenced by the numeral 22; a pair of liquid storage containers, generally referenced by the numeral 24*a*, 24*b*, interlinked by a transfer conduit 26 having a transfer valve 28; a drinking tube assembly, generally referenced by the numeral 30, in connection with one of the liquid storage containers 24*a*, 24*b*; and a spray nozzle assembly, generally referenced by the numeral 32, in connection with the other liquid storage container 24*a*, 24*b*.

Figure 2:
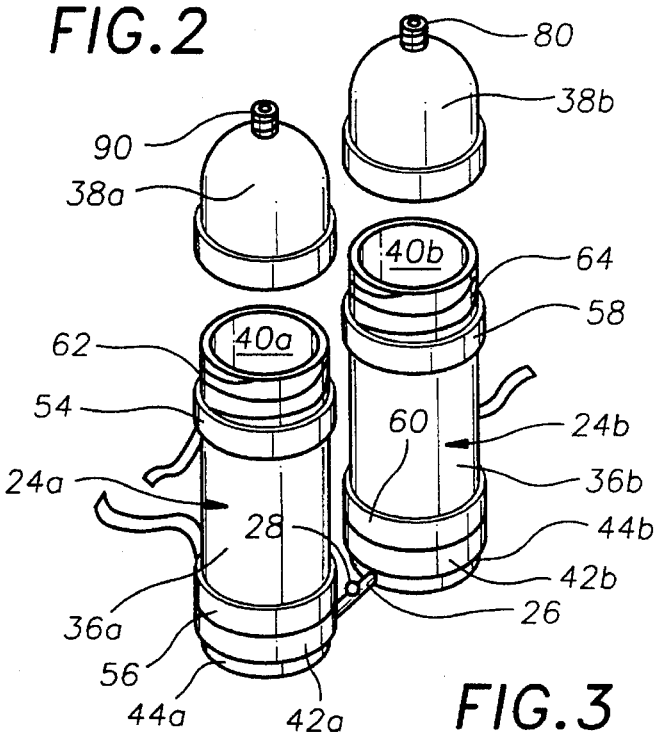
FIG. 2 is a perspective, partially exploded view of the portable liquid supply with the loading mouth lids unscrewed.

FIG. 2 shows liquid storage containers 24*a*, 24*b* with drinking tube assembly 30 and spray nozzle assembly 32 removed. Each liquid storage container 24*a*, 24*b* is constructed from an insulating, plastic. As shown in the figure each liquid storage container 24*a*, 24*b* includes a bottom reservoir member 36*a*, 36*b* and a loading mouth lid 38*a*, 38*b*. Bottom reservoir members 36*a*, 36*b* include a loading mouth 40*a*, 40*b* in connection with an internal storage cavity for storing the liquid. A loop stop 42*a*, 42*b* in the form of an integrally formed circumferential ring extends around a bottom section of bottom reservoir members 24*a*, 24*b* about one and one-half (1 ½") inches above a bottom edge 44*a*, 44*b* and about one-half (½") inch above transfer conduit 26. Each loop stop 42*a*, 42*b* extends outwardly from the exterior surface of a bottom reservoir member 24*a*, 24*b* about one-half (½") inch. Transfer valve 28 is installed within transfer conduit 26 between bottom reservoir members 36*a*, 36*b* to allow a user to transfer liquid between the bottom reservoir members if desired.

Figure 3:
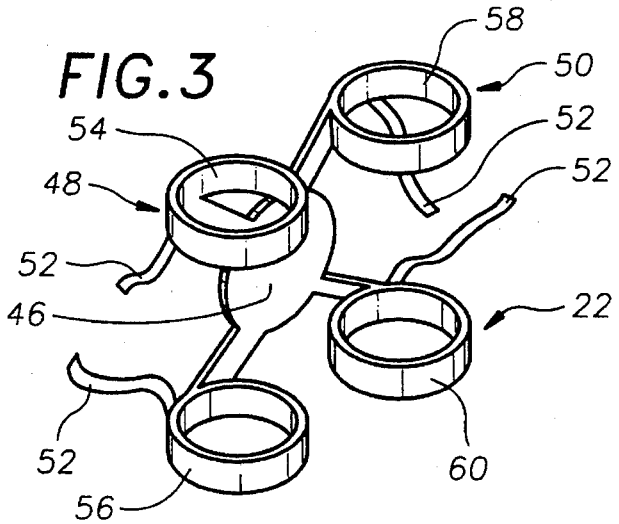
FIG. 3 is a perspective view of the container support frame showing the four container support loops.

FIG. 3 is a perspective view of container support frame 22. As shown, container support frame 22 includes a central support member 46 connected between a first liquid storage container support, generally referenced by the numeral 48, and a second liquid storage container support, generally referenced by the numeral 50; and four lashing strap members 52. First liquid storage container support 48 includes a pair of spaced, coaxially aligned container support loops 54, 56. Second liquid storage container support 50 includes a pair of spaced, coaxially aligned container support loops 58, 60. The diameter of each container support loop 54, 56, 58, 60 is about one-eighth (⅛") inch greater than the external diameter of bottom reservoir sections 24*a*, 24*b*. Using this diameter allows a top section of bottom reservoir members 24*a*, 24*b* to pass through support loops 54, 56, 58, 60 but to prevent loop stop 42*a*, 42*b* of bottom reservoir members 24*a*, 24*b* from passing therethrough.

With reference once again to FIG. 2, the distance between container support loops 54, 56 and the distance between container support loops 58, 60 is selected such that, when loop stops 42*a*, 42*b* are in contact with container support loops 56 and 60, respectively, top sections 62, 64 of bottom reservoir members 36*a*, 36*b* extend through and past container support loops 54 and 58, respectively. As shown in the figure, top sections 62, 64 are externally threaded for connection with the internally threaded cavity (not shown) of loading mouth lids 38*a*, 38*b* respectively.

The outer diameter of loading mouth lids 38*a*, 38*b* is about equal to the outer diameter of loop stops 42*a*, 42*b*. The external threading on top sections 62, 64 and the internal threading of loading mouth lids 38*a*, 38*b* are positioned such that loading mouth lids 38*a*, 38*b* contact container support loops 54, 58, respectively, when loading mouth lids 38*a*, 38*b* are threaded onto top sections 62, 64. When loading mouth lids 38*a*, 38*b* are thus configured, as shown in FIG. 1, liquid storage containers 24*a*, 24*b* are prevented from moving by first liquid storage container support 48 and second liquid storage container support 50 respectively.

Figure 4:
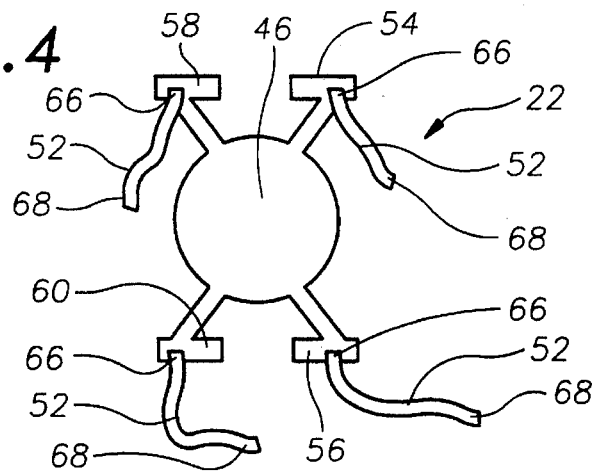
FIG. 4 is a side view of the back side of the container support frame showing the four lashing members.

FIG. 4 is a side view of the back side of container support frame 22 showing the connections between the four lashing members 52 and container support frame 22. In this embodiment lashing members 52 are about fourteen inch lengths of woven nylon strapping having a first end 66 adhesively secured to a support loop 54, 56, 58, 60. The second ends 68 of lashing members 52 may be tied to one another about various support structures such as rails and truck sides, and configured to fashion a carrying pack with two lashing members 52 forming a right shoulder harness and two lashing members 52 connected to form a left shoulder harness. In the carrying pack configuration central support member 46 contacts the back of the person carrying support frame 22.

Figure 5:
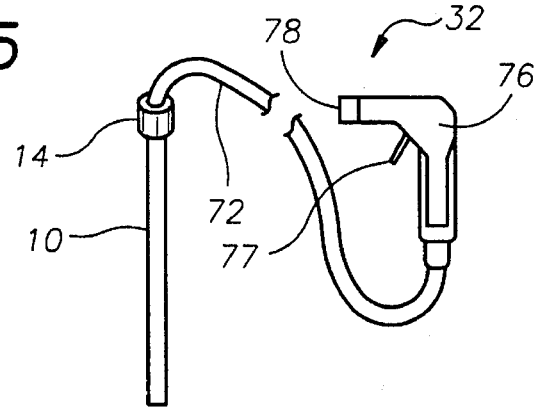
FIG. 5 is a perspective view of the spray nozzle assembly showing the draw tube and the squeeze spray nozzle.

FIG. 5 is a perspective view of spray nozzle assembly 32 in isolation. Spray nozzle assembly 32 includes a draw tube 70, a flexible connecting tube 72, a tube aperture cap 74, and a pump-type spray nozzle 76. Tube aperture cap 74 is internally threaded to secure tube aperture cap 74 to an externally threaded tube aperture 80 (shown in FIG. 2). In use, draw tube 70 is inserted through tube aperture 80 and held in position by tube aperture cap 74. Pump-type spray nozzle 76 is of conventional construction having a trigger actuator 77 and an adjustable spray orifice 78.

Figure 6:
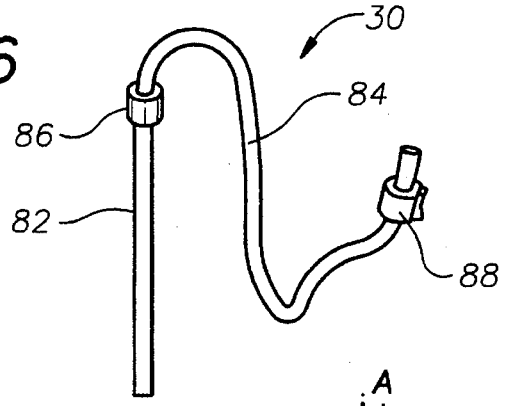
FIG. 6 is a perspective view of the drinking tube assembly showing the draw tube and the drinking tube valve.

FIG. 6 is a perspective view of drinking tube assembly 30 in isolation. Drinking tube assembly 30 includes a draw tube 82, a flexible drinking tube 84, a tube aperture cap 86, and a drinking tube valve 88. Tube aperture cap 86 is internally threaded to secure tube aperture cap 86 to an externally threaded tube aperture 90 (shown in FIG. 2) In use, draw tube 82 is inserted through tube aperture 90 and held in position by tube aperture cap 86.

Figure 7:
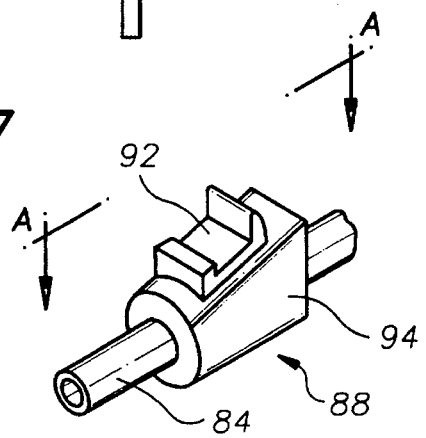
FIG. 7 is a detail, perspective view of the drinking tube valve.
Figure 8:
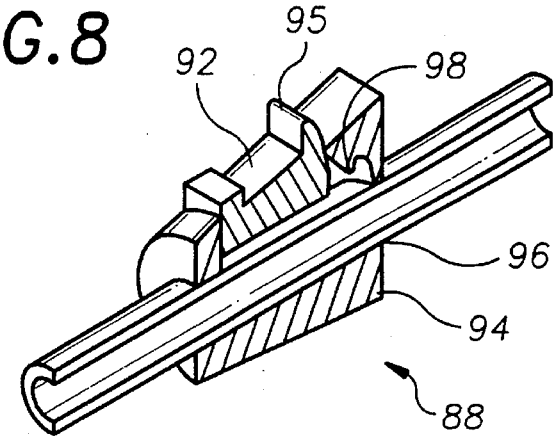
FIG. 8 is a cross-sectional, perspective view of the drinking tube valve of FIG. 7 along the line A—A with the pinch button in the non-pinching position.
Figure 9:
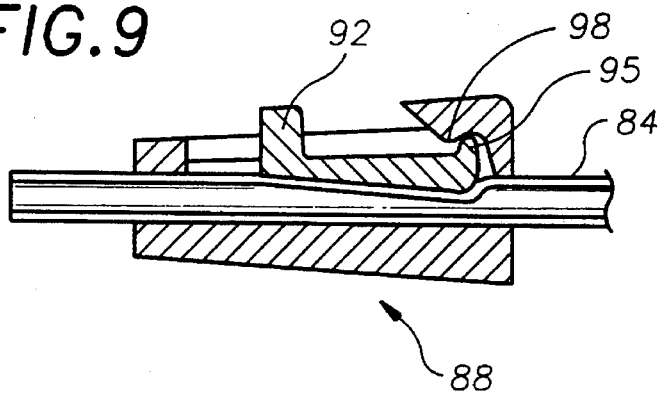
FIG. 9 is a cross-sectional, side view of the drinking tube valve of FIG. 7 along the line A—A with the pinch button in the pinching position.
Figure 10:
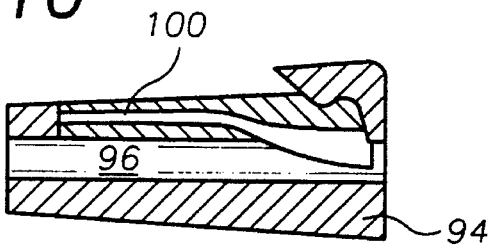
FIG. 10 is a cross-sectional, side view of the valve housing member with the pinch button removed for clarity.
Figure 11:
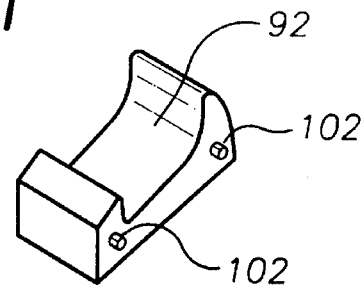
FIG. 11 is a perspective view of the pinch button of the drinking tub valve showing two of the raceway engaging projections.

FIG. 7 is a detail, perspective view of drinking tube valve 88 in connection with a portion of flexible drinking tube 84. Drinking tube valve includes a pinch button 92 and a valve housing member 94. FIG. 8 is a cross-sectional view of drinking valve 88 along the line A—A of FIG. 7 showing pinch button 92 in the non-pinching position with a pinch button lip 95 extending exteriorly of valve housing member 94. Valve housing member 94 includes a drinking tube passage 96 and a pinch button lip catch 98. FIG. 9 is a cross-sectional, side view of the drinking tube valve 88 with pinch button 92 in the pinching position. In the pinching position, pinch button lip 95 is engaged and held against flexible drinking tube 84 by pinch button lip catch 98. When pinch button 92 is in this position, flexible drinking tube 84 is pinched shut preventing the flow of water therethrough. FIG. 10 is a cross-sectional, side view of valve housing member 94 with pinch button 92 and flexible drinking tube 84 removed to more clearly show drinking tube passageway 96 and one of two raceways 100. FIG. 11 is a perspective view of pinch button 92 in isolation showing two of the four raceway engaging projections 102 extending therefrom that are slidably entrapped within raceways 100 during use.

Use of portable liquid supply 20 is now described with general reference to FIGS. 1–11. Portable liquid supply 20 is refilled as follows. Transfer valve 28 is placed in the closed non-transferring position and liquid storage containers **24*a*, 24*b* are filled with a liquid, such as water, through loading mouth apertures 40*a*, 40*b*. Liquid storage containers 24*a*, 24*b* are then sealed by threading loading mouth lids 38*a*, 38*b* onto top sections 62, 64. If drinking tube assembly 30 and spray nozzle assembly 32 are not already secured to loading mouth lids 38*a*, 38*b*, respectively, then this is performed by threading tube aperture caps 86, 74 onto tube apertures 90, 80 respectively. Portable liquid supply 20 is then transported to a desired location and lashed in place using lashing members 52. Once portable liquid supply 20 is secured in a desired location, spray nozzle assembly 32 may be used to spray individuals with a cooling mist and drinking water assembly 30 may be used to provide drinking water to individuals in a straw -type fashion. If one of the liquid storage containers 24*a*, 24*b* becomes to low to provide liquid therefrom, additional liquid may be transferred from the other liquid storage container 24*a*, 24*b* by opening transfer valve 28 until the levels within the two liquid storage containers 24*a*, 24*b*** equalize.

It can be seen from the preceding description that a portable liquid supply has been provided that includes a misting mechanism supplied by liquid stored within the portable liquid supply; that includes a dispensing mechanism that does not require the use of a serving vessel such as a cup; that includes a drinking liquid reservoir and a cooling liquid reservoir that are separated by a transfer conduit having a valving mechanism; and that includes storage reservoirs that are easily cleaned.

It is noted that the embodiment of the portable liquid supply described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable liquid supply comprising:

a first liquid storage container including a first bottom reservoir member having a first loading mouth in connection with a first internal storage cavity, and a first loading mouth lid, securable over said first loading mouth aperture, having a first tube aperture, said first bottom reservoir member including a first loop stop in connection with a first exterior surface thereof extending outwardly from said first exterior surface;

a second liquid storage container including a second bottom reservoir member having a second loading mouth in connection with a second internal storage cavity, and a second loading mouth lid, securable over said second loading mouth aperture, having a second tube aperture, said second bottom reservoir member including a second loop stop in connection with a second exterior surface thereof extending outwardly from said second exterior surface;

a transfer conduit, having a transfer valve installed in line therein, in fluid connection between said first and said second reservoir bottom members;

a drinking tube assembly in fluid connection with one of said liquid storage containers;

a spray nozzle assembly in fluid connection with said other liquid storage container; and a container support frame including a central support member connected between a first and second liquid storage container support, each of said first and second liquid storage container supports including a pair of spaced, coaxially aligned container support loops, a diameter of each container support loop is selected to allow a top section of said bottom reservoir member to pass therethrough but to prevent said loop stop of said bottom reservoir member from passing through said support loop, a spacing between said container support loops forming each of said pairs of support loops is selected such that, when said loop stop is in contact with one of said container support loops, said top section of said bottom reservoir member extends through and past said other coaxially oriented container support loop a distance sufficient to allow said loading mouth lid to be secured over said loading mouth of said bottom reservoir member in a manner such that said loading mouth lid prevents passage of said top section through said adjacent container support loop.

2. The portable liquid supply of claim 1, wherein:

said top section of each of said first and second bottom reservoir member is externally threaded;

each of said loading mouth lids includes an internally threaded cavity;

an outer diameter of said loading mouth lid is greater than said diameter of said container support loops; and said external threading on said top section and said internal threading of said loading mouth lid are positioned such that, when said loading mouth lid is completely threaded onto said top section, said loading mouth lid contacts a container support loop in a manner such that said liquid storage container is prevented from moving with respect to said pair of container support loops supporting said liquid storage container.

3. The portable liquid supply of claim 1, wherein:

said transfer conduit is connected between said first and second internal storage cavities of said first and second bottom reservoir members at a point at least one-half inch from an interior bottom surface defining each of said first and second internal storage cavities.

4. The portable liquid supply of claim 1 wherein:

said drinking tube assembly includes a draw tube, a flexible drinking tube, a tube aperture cap, and a drinking tube valve, said drinking tube valve including a pinch button and a valve housing, said pinch button including a pinch button lip, said valve housing including a drinking tube passage and a pinch button lip catch, said pinch button lip engaging said pinch button lip catch when said transfer valve is blocking flow of liquid through said drinking tube.

5. The portable liquid supply of claim 2, wherein:

said transfer conduit is connected between said first and second internal storage cavities of said first and second bottom reservoir members at a point at least one-half inch from an interior bottom surface defining each of said first and second internal storage cavities.

6. The portable liquid supply of claim 5 wherein:

said drinking tube assembly includes a draw tube, a flexible drinking tube, a tube aperture cap, and a drinking tube valve, said drinking tube valve including a pinch button and a valve housing, said pinch button including a pinch button lip, said valve housing including a drinking tube passage and a pinch button lip catch, said pinch button lip engaging said pinch button lip catch when said transfer valve is blocking flow of liquid through said drinking tube.

7. The portable liquid supply of claim 2 wherein:

said drinking tube assembly includes a draw tube, a flexible drinking tube, a tube aperture cap, and a drinking tube valve, said drinking tube valve including a pinch button and a valve housing, said pinch button including a pinch button lip, said valve housing including a drinking tube passage and a pinch button lip catch, said pinch button lip engaging said pinch button lip catch when said transfer valve is blocking flow of liquid through said drinking tube.

* * * * *